US008237070B2

(12) United States Patent
Zhang

(10) Patent No.: US 8,237,070 B2
(45) Date of Patent: Aug. 7, 2012

(54) SET OF CIRCUIT BREAKERS WITH INTERLOCK MEANS

(75) Inventor: Aijun Zhang, Zunyi (CN)

(73) Assignee: Zhejiang Chint Electrics Co., Ltd., Wenzhou (CN)

( * ) Notice: Subject to any disclaimer, the term of this patent is extended or adjusted under 35 U.S.C. 154(b) by 489 days.

(21) Appl. No.: 12/307,521

(22) PCT Filed: Jul. 3, 2007

(86) PCT No.: PCT/CN2007/002062

§ 371 (c)(1), (2), (4) Date: Aug. 25, 2009

(87) PCT Pub. No.: WO2008/006296

PCT Pub. Date: Jan. 17, 2008

(65) Prior Publication Data

US 2009/0321239 A1 Dec. 31, 2009

(30) Foreign Application Priority Data

Jul. 3, 2006 (CN) ..... 2006 1 0090354

(51) Int. Cl.
*H01H 1/20* (2006.01)

(52) U.S. Cl. ..... 200/50.32; 200/5 B; 200/337

(58) Field of Classification Search ..... 200/50.32, 200/50.01, 5 B, 337, 331, 17 R, 50.33, 50.37
See application file for complete search history.

(56) References Cited

U.S. PATENT DOCUMENTS

| | | | | |
|---|---|---|---|---|
| 4,691,180 | A | 9/1987 | Grunert et al. | |
| 5,227,952 | A | 7/1993 | Romano et al. | |
| 5,486,978 | A | 1/1996 | Fishovitz | |
| 5,895,898 | A * | 4/1999 | Godesa | 200/50.32 |
| 6,060,668 | A * | 5/2000 | Azzola et al. | 200/5 B |
| 6,995,327 | B1 | 2/2006 | Shepstone et al. | |

FOREIGN PATENT DOCUMENTS

| | | | |
|---|---|---|---|
| CA | 2531211 | A1 | 6/2006 |
| CN | 87104264 | A | 3/1988 |
| CN | 1185640 | A | 6/1998 |
| EP | 0853324 | A2 | 7/1998 |
| EP | 1204127 | A | 5/2002 |
| EP | 0853324 | B1 | 9/2003 |

OTHER PUBLICATIONS

European Search Report for Application No. 07721622.4-1231, dated Aug. 19, 2010.

International Search Report issued in International Application No. PCT/CN2007/002062, dated Oct. 11, 2007.

Written Opinion issued in International Application No. PCT/CN2007/002062, dated Sep. 24, 2007.

International Preliminary Report on Patentability issued in International Application No. PCT/CN2007/002062, dated Jan. 6, 2009.

* cited by examiner

*Primary Examiner* — Vanessa Girardi

(74) *Attorney, Agent, or Firm* — McCarter & English, LLP

(57) ABSTRACT

A set of circuit breakers with interlock means, particularly a set of circuit breakers capable of realizing any mechanical interlock and unlock between two or more circuit breakers, wherein in the set of circuit breakers, each circuit breaker has an interlock means, said interlock means comprising a base plate 5, a driving lever (22; 23; 24), a control lever 8, two control arms 27, 28, three tension springs 10, 11, 12, and six cables 13, 14, 15, 16, 17, 18, two cables connected to two ends of the driving lever of each circuit breaker are respectively connected to a control arm of the other two circuit breakers.

13 Claims, 8 Drawing Sheets

SET OF CIRCUIT BREAKERS WITH INTERLOCK MEANS

RELATED APPLICATIONS

The present application is a 35 U.S.C. 371 national stage filing of International Application No. PCT/CN2007/002062, filed Jul. 3, 2007, which claims priority to Chinese Application No. 200610090354.5, filed Jul. 3, 2006. The entire contents of each of these applications are hereby incorporated herein by reference.

FIELD OF THE INVENTION

The present invention relates to a set of circuit breakers with interlock means, and in particular, relates to a set of circuit breakers for mechanically interlocking at least three circuit breakers.

BACKGROUND OF THE INVENTION

In a power distribution system that supplies power with multiple loops, each loop is provided with a circuit breaker, and a circuit breaker which is typically switch-off and acts as an interconnection switch or a loop switch is provided between loops. If a loop therein disconnects due to power failure, the circuit breaker acting as an interconnection switch or a loop switch will close so as to ensure normal operation and power supply of the multi-loop power system mounted with the circuit breakers and of the load connected to the circuit breakers.

In practical application, a circuit breaker is required to perform some auxiliary functions aside from its normal operation functions so as to guarantee safety, for example, mechanical interlocking between two or more circuit breakers is required, aside from the electric interlocking between the set of circuit breakers having circuit breakers acting as interconnection switches or loop switches.

To implement interlocking between the set of circuit breakers, the mechanical interlocking methods and devices employed in the prior art are key interlock, leverage interlock and wire rope interlock, which are named by motion translation mediums. The mechanically interlocking circuit breaker means employed in current key interlock has a disadvantage that in-field manual operation is required to unlock the interlock, which can not satisfy the demand of automatic control.

In the prior art, some mechanically interlocking circuit breakers use the leverage interlock or wire rope interlock means or their combination with the key interlock means, disadvantage of which means lies in that only interlock between two circuit breakers can be implemented, and for interlock between three circuit breakers, random combination can not be implemented. Besides, under the current technical state, the known interlocking means for circuit breakers still have some drawbacks or performance deficiencies, though they can provide operating functions as required.

An invention patent No. 97125954.2 discloses a set of switches with interlock means, which discloses specifically the following technical features for this known mechanical interlock means: each switch has an elastically supported rocker, each rocker being operatively connected to means capable of locking a corresponding switch, each switch having a drive means connected to two ends of two cables. Since this known rocker that forms a mechanical interlocking means with cables is elastically supported, it is highly demanding on mounting and adjustment, with relatively poor repetitive positioning precision and vibration-proof performance. For a rocker directly connected to a trigger, its poor repetitive position precision and vibration-proof performance greatly affects the working reliability and robustness of the switches.

Specifically, since the force for locking a trigger in the prior art is directly the tensile force of a cable, movement of the rocker is realized by axial movement of the wire ropes inside the cable, thus it is highly demanding on the positioning precision of the cable member, which causes problems such as difficulty for adjustment, low productivity and high processing cost. Besides, in use, it is inevitable that connection of wire ropes becomes loose and deformed and that wire ropes become lengthened under tensile force. These problems directly impair positioning precision of the cable member, make locking operation out of order, and greatly affect the product's safety, reliability, robustness and service life.

SUMMARY OF THE INVENTION

To overcome the above-mentioned drawbacks in the prior art, an objective of the present invention is to provide a set of circuit breakers having improved mechanical interlock means, the circuit breakers can not only satisfy the demand of automatic control, but also realize random combination of interlock/release between multiple circuit breakers, so as to meet different requirements on product interlock in practical operations.

Another important objective of the present invention is to provide a set of circuit breakers having interlock means, which has a good safety, robustness and reliability, is convenient for operating and adjusting, and is low in manufacturing cost but long in service life, so as to overcome the drawbacks in the constructional principle of the prior art circuit breaker mechanical interlocking mechanism means.

To achieve the above objectives, the present invention adopts the following solutions:

A set of circuit breakers with interlock means according to the present invention comprises at least three circuit breakers and at least six cables, wherein each circuit breaker in the set of circuit breakers has interlock means, the interlock means of each circuit breaker are interconnected by cables to translate drive force, each interlock means comprises a drive member, a control member, a locking member, a base plate, and a cable mechanism; the base plate of the interlock means is provided with at least one control lever, at least one driving lever, at least two control arms and three elastic elements; the driving lever is operatively connected to a driving mechanism on the each circuit breaker; and the control lever is connected to a trigger of a circuit breaker locking means. Wire ropes of two cables that are connected to two ends of the driving lever of any of the circuit breakers are connected to a control arm of each of the other two circuit breakers. The control arm, under the joint action of the tensile force of the wire ropes and the elastic force of the elastic element, performs restricting or releasing the movement of the control lever. After movement of the control lever is released, under the elastic force of the elastic element, the control lever automatically completes locking a locking shaft of the each circuit breaker.

The drive member of the present invention has a driving lever whose two ends having a connection mechanism that bears cables, through which connection mechanism the driving lever connects two cables; in the middle of the driving lever is provided a shaft perpendicular to the driving lever, one end of the shaft being fixedly attached to the driving lever, middle of the shaft being movably attached to an access hole in the base plate, the other end of the shaft being attached to a driving means at the rear of the base plate and for operating the circuit breaker to open/close. The control member comprises two control arms, one end of each control arm having a hole movably attached to a shaft fixed on the base plate such that the control arms are rotatable around the shaft center, the other end of each control arm being fixed connected to wire ropes of the cable, the wire ropes translating drive force of the driving lever to control arms of the other two circuit breakers. Each control arm is provided with a tension spring the other end of which is attached to the base plate. The direction of the tensile force of the tension spring is reversal to that of wire ropes. The control member has a control lever two ends of which are provided with two male tabs, middle of the control lever being fixedly attached to a shaft movably connected to the access hole in the base plate such that the control lever is rotatable around the shaft center, the other end of the shaft going through the base plate and adapted for being connected to the trigger of the circuit breaker at the rear of the base plate. On the control lever is provide a tension spring the other end of which is fixedly attached to the base plate. Under the joint action of the tensile force of the tension spring on the control lever and the tensile force of the wire ropes on the control arm, the mail tabs on the control lever may be maintained in contact or not in contact with a side edge of the control arm. The cable comprises wire ropes and a sheath, the wire ropes being located in the middle of the sheath, and when two ends of the sheath are fixed, axial displacement between the wire ropes and the sheath is generated by pulling the wire ropes, thereby realizing the function of long-distance translation of axial movement. As to the cable mechanism, one ends of the wire ropes are fixed on one end of the driving lever of a circuit breaker in the set of circuit breakers, the other ends of the wire ropes are fixed on one end of the control arm of another circuit breaker of the set of circuit breaker, with two ends of the sheath being respectively fixed on the base plates corresponding to two circuit breakers which fix the wire ropes.

For the set of circuit breakers with mechanical interlock means according to the present invention, when operating the drive means of one circuit breaker in the set of circuit breakers, the drive means drives the driving lever on the circuit breaker to rotate, rotation of which strains two wire ropes connected to two ends of the driving lever. By two strained wire ropes, side edges of the control arms of the other two circuit breakers of the set of circuit breakers are driven to separate from the male tabs of the control levers, thereby releasing the restriction to the control lever of the target circuit breaker, such that the control lever of the target circuit breaker, under the tensile force of the tension spring, realizes the required interlock of the set of circuit breakers. In reverse, when the wire ropes are released, due to the action of the tension spring on the control arm, the control arm may be reset and contact with the male tabs on the control lever, thereby realizing the required unlocking of the set of circuit breakers. According to the present invention, after the cables interconnects each circuit breaker of the set of circuit breakers in the predetermined connection way, through setting open/close of each circuit breaker, random combination of a plurality of circuit breaker states can be implemented, for example, when any two of the three circuit breakers switch on, the third circuit breaker can not switch on.

BRIEF DESCRIPTION OF THE DRAWINGS

Hereinafter, the embodiments of the present invention are descried with reference to the accompanying drawings as below.

DESCRIPTION OF THE PREFERRED EMBODIMENTS

Hereinafter, the preferred embodiments of the set of circuit breakers wither interlock means of the present invention are further described in detail by way of examples in the appended drawings.

The following example illustrates a set of circuit breakers comprising three circuit breakers according to the present invention, based on which the working principle and advantages of the interlock means of the present invention are illustrated. The set of circuit breakers according to the present invention is not limited to a set of circuit breakers comprising three circuit breakers.

Figure 1:
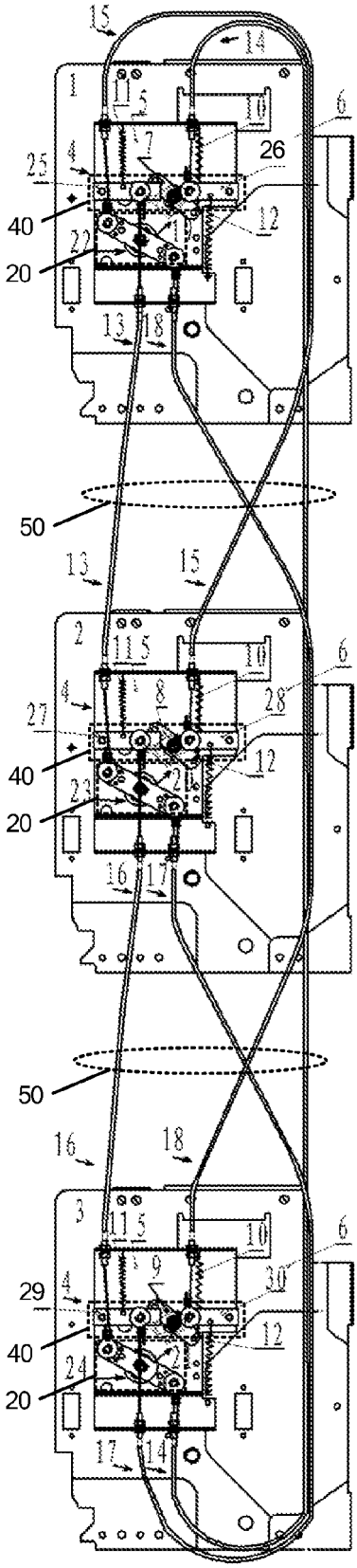
FIG. 1 is a side view of three interconnected circuit breakers with interlock means according to an embodiment of the present invention.

As shown in FIG. 1, a set of circuit breakers of the invention comprises circuit breakers 1, 2, 3. On the three circuit breakers, each circuit breaker has an interlock means 4. Each interlock means 4 comprises a drive member 20, a control member 40, a locking member (which can not be seen since it is hidden by other members), a base plate 5, and a cable mechanism 50. Taking circuit breaker 2 as an example, the drive member 20 of the present invention has a driving lever 23 with two ends having a connection mechanism that bears cables. The driving lever 23 connects two cables through the connection mechanism. In the middle of the driving lever 23 is provided a shaft perpendicular to the driving lever 23. One end of the shaft is fixedly attached to the driving lever 23, and the middle of the shaft is movably attached to an access hole in the base plate 5, and the other end of the shaft is attached to a driving means at the rear of the base plate 5 for operating the circuit breaker 2 to open/close. The control member 40 comprises two control arms 27, 28 and a control lever 8. One end of each control arm 27, 28 has a hole movably attached to a shaft fixed on the base plate 5 such that the control arms are rotatable around the shaft center. The other end of each control arm 27, 28 is fixedly connected to wire ropes of the cable. The wire ropes translate a drive force of the driving lever 23 to the control arms 27, 28 of the other two circuit breakers. Each control arm 27, 28 is provided with a tension spring 11/12, and the other end of each control arm is attached to the base plate 5. The direction of the tensile force of the tension spring is opposite to that of the wire ropes. Two ends of the control lever 8 are provided with two male tabs and the middle of the control lever 8 is fixedly attached to a shaft 60 that is movably connected to the access hole in the base plate 5 such that the control lever is rotatable around the shaft center. The other end of the shaft goes through the base plate 5 and is adapted for being connected to the trigger of the circuit breaker 2 at the rear of the base plate 5. On the control lever 8 is provided a tension spring 10, and the other end of the tension spring 10 is fixedly attached to the base plate 5. Under the joint action of the tensile force of the tension spring on the control lever 8 and the tensile force of the wire ropes on the control arm 27, 28, the male tabs on the control lever 8 may be maintained in contact or not in contact with a side edge of the control arm. The locking member comprises a locking means comprising a shaft 71. The cable comprises wire ropes and a sheath. The wire ropes are located in the middle of the sheath, and when two ends of the sheath are fixed, an axial displacement between the wire ropes and the sheath is generated by pulling the wire ropes, thereby realizing the function of long-distance translation of axial movement. As to the cable mechanism, one end of each wire rope is fixed on one end of a driving lever 23 of a circuit breaker in the set of circuit breakers 1, 2, 3. The other ends of the wire ropes are fixed on one end of the control arm of another circuit breaker of the set of circuit breakers 1, 2, 3, with two ends of the sheath being respectively fixed on the base plates 5 corresponding to two circuit breakers which fix the wire ropes.

Figure 2:
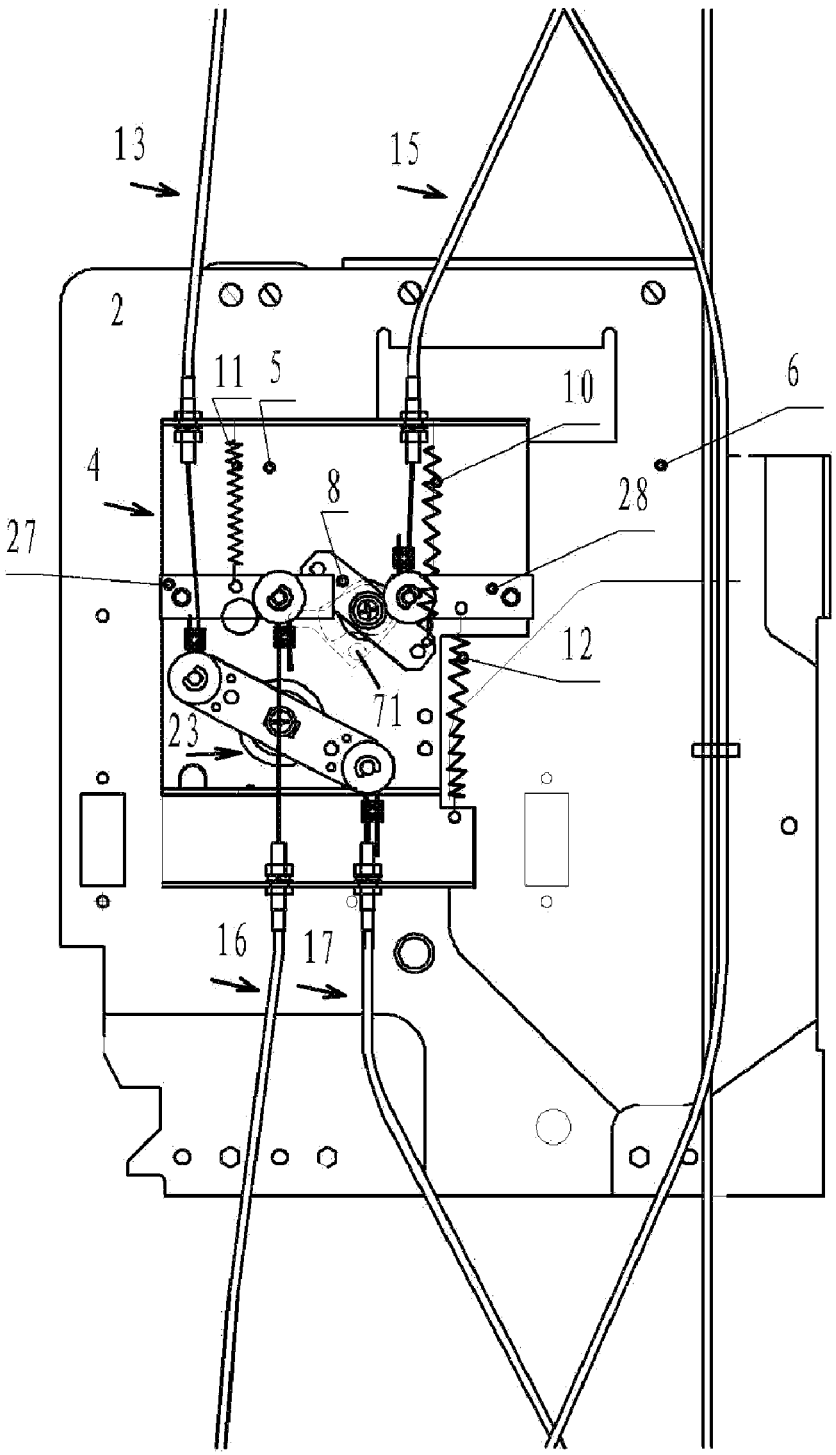
FIG. 2 is a structural diagram of the second circuit breaker shown in FIG. 1.
Figure 3:
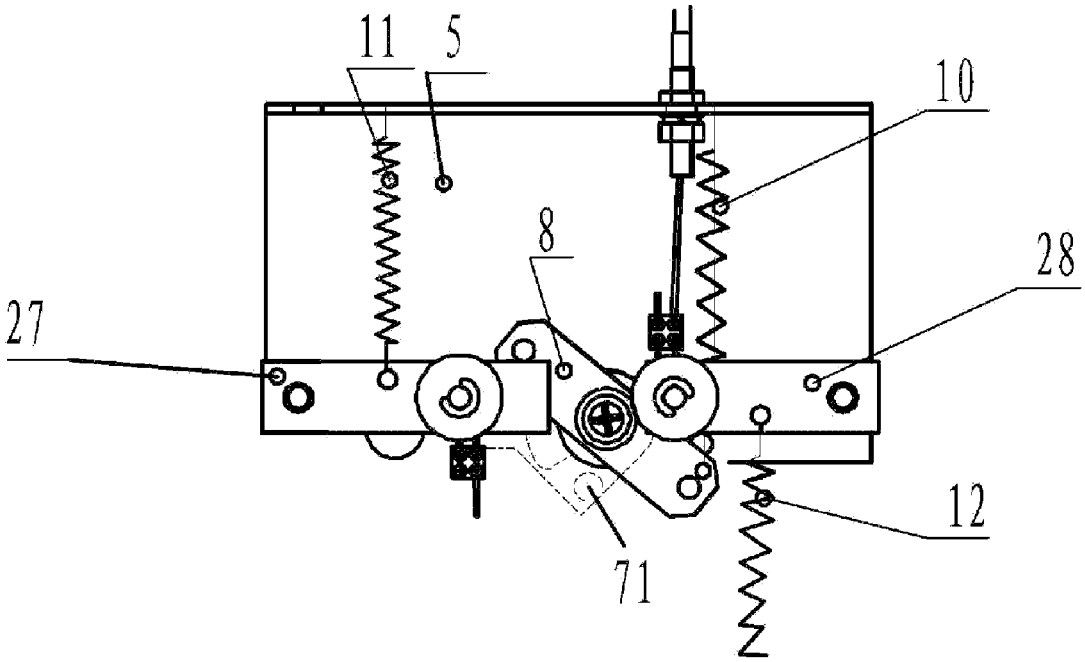
FIG. 3 is a structural diagram of control arms 27, 28 which are disposed on the second circuit breaker and not affected by transmission of drive means of other circuit breakers, as well as of a control lever 8 whose movement is restricted.
Figure 4:
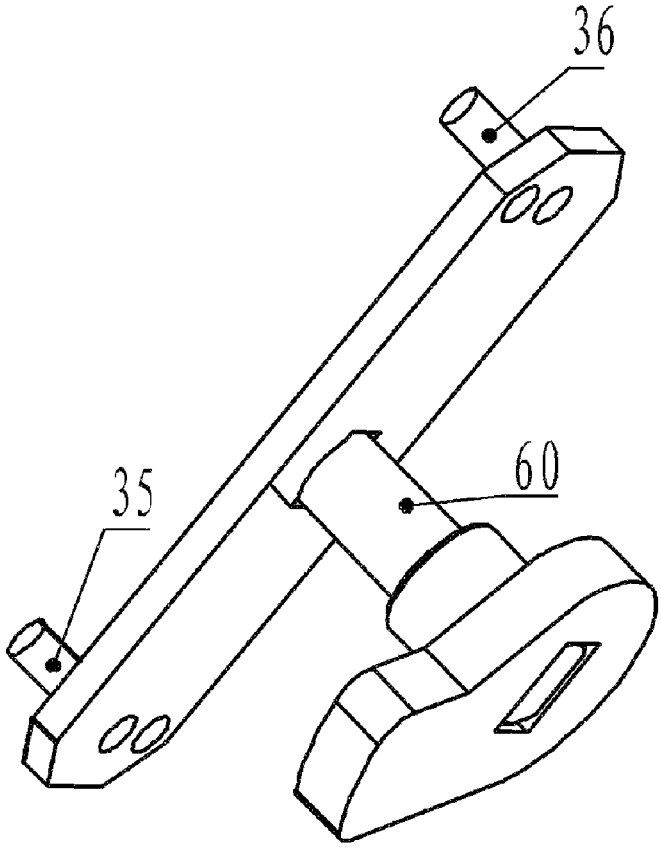
FIG. 4 is a three-dimensional diagram of the control lever 8 shown in FIG. 3.
Figure 5:
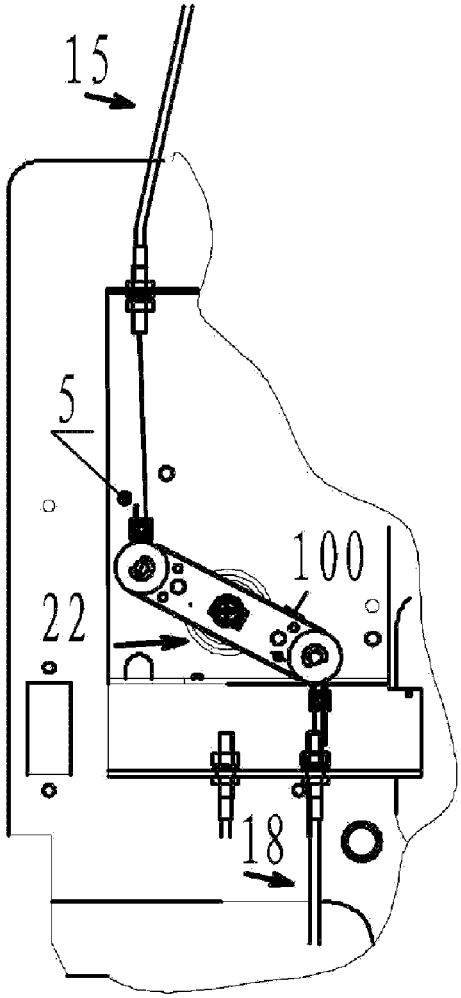
FIGS. 5 and 6 diagrammatically illustrate two positions of a driving lever 22 of the first circuit breaker.

From FIGS. 2, 3 and 4, it can be seen that the interlock means 4 is fixed to a side plate 6 of the circuit breaker via a base plate 5. Parallel to the base plate 5 is provided a control lever 8 in the middle of which is provided a shaft 60 attached movably to a hole in the base plate 5. At two ends of the control lever 8 are provided two male tabs 35, 36, and at an appropriate position of the right end is attached a tension spring 10. When the restricting condition is completely eliminated, under the action of the tension spring 10, the control lever 8 is rotatable around the shaft center of the shaft 60. The shape of the control lever 8 is shown in FIG. 4. Driving levers are designated 22 in the first circuit breaker 1, 23 in the second circuit breaker 2, and 24 in the third circuit breaker 3. Taking the circuit breaker as an example, the driving lever 23 is disposed parallel on the base plate 5, the middle of the driving lever 23 is attached to a shaft that is movably attached to a hole in the base plate 5. The other end of the shaft is operationally attached to a plurality of triggers or indicator triggers of drive means of the circuit breaker, for example, attached to a main shaft fixed to the operating mechanism of the circuit breaker 2. The left end of the driving lever 23 is fixedly attached to wire ropes of the cable 13, with the right end being fixedly attached to wire ropes of the cable 17. Parallel to the base plate 5 are provided two control arms 27, 28. One ends of the control arms 27, 28 are provided with a hole movably attached to the shaft on the base plate 5. The other end of the control arm 27 is fixedly attached to wire ropes of the cable 16 via a roller, an appropriate position in the middle of the control arm 27 being attached to the tension spring 11. The other ends of the control arm 28 is fixedly attached to wire ropes of the cable 15, an appropriate position in the middle of the control arm 28 being attached to the tension spring 12. The other ends of the tension springs 11, 12 are respectively attached to the base plate 5. Each end of the sheaths of the cables 13, 15, 16, 17 is respectively fixed to the base plate 5 with a threaded terminal.

Hereinafter, the working principle of the interlocking mechanism of the present invention is described with reference to FIGS. 1, 5, 6, 7, 8, and 9.

When all the three circuit breakers 1, 2 and 3 are in the opened positions, the control arm 27 is subject to tensile force of the tension spring 11 from the above and tensile force of the wire ropes 16 from the below. When the control arm 27 is located in the position such that the male tab 35 on the control lever 8 comes into contact with a side edge of the control arm 27, the control lever 8 comes (see FIG. 9) or does not come (see FIG. 8) into contact with a locking means of the circuit breaker, thereby at least not affecting the reliable switch-on of the circuit breaker. The control arm 28 is subject to tensile force of the tension spring 10 from the below and tensile force of the wire ropes 15 from the above. When the control arm 28 is located in the position such that the male tab 36 on the control lever 8 comes into contact with a side edge of the control arm 28, the control lever 8 comes or does not come into contact with the locking means, thereby at least not affecting the reliable switch-on of the circuit breaker.

Figure 6:
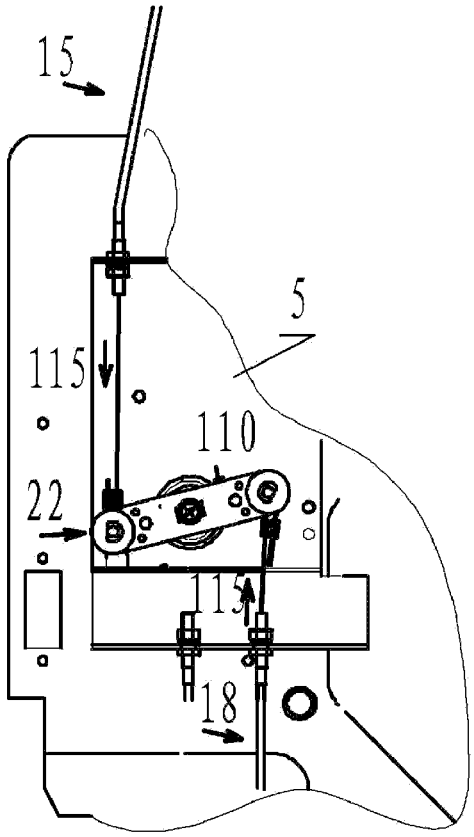
Figure 7:
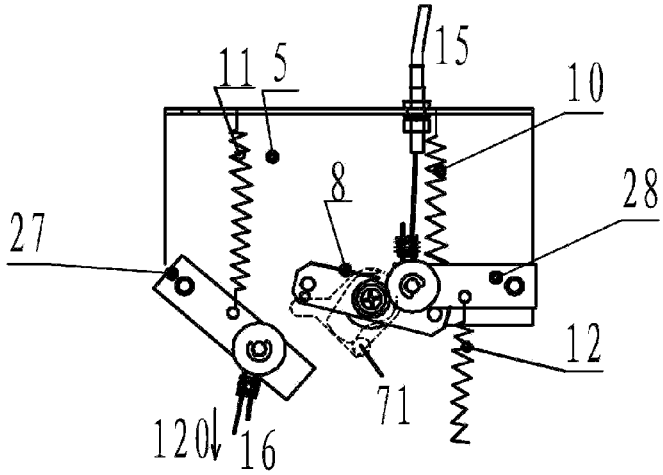
FIGS. 7 to 9 are diagrams of final positions of control arms 27, 28 after being driven by drive means of other different circuit breakers, and of control lever 8 of the second circuit breaker.
Figure 8:
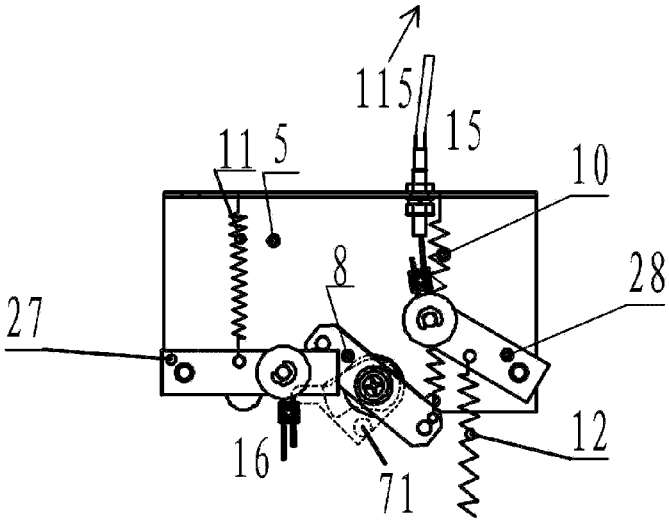
Figure 9:
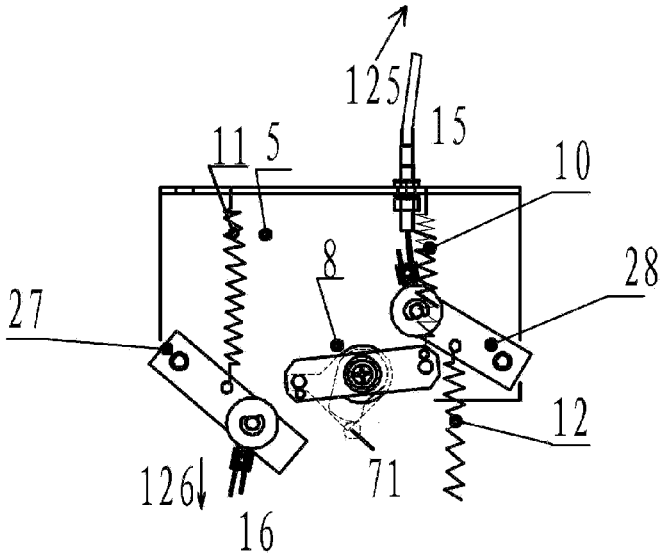

When, for example, only the first circuit breaker 1 switches on, the driving lever 22 of the first circuit breaker 1 is rotated to position 110, thereby straining wire ropes 15, 18 with tensile force 115 (see FIG. 6). Since the tensile force 115 strains the wire ropes 15, the control arm 28 of the second circuit breaker 2 is rotated clockwise (see FIG. 1 and FIG. 8), thereby eliminating its restriction on rotational movement of the control lever 8. Due to restriction of the control arm 27, the control lever 8 still maintains a certain distance from the shaft 71 of the locking means, thereby at least not affecting the reliable switch-on of the circuit breaker 2.

When only the third circuit breaker 3 switches on, the driving lever 24 of the third circuit breaker 3 strains the wire ropes 16 with the tensile force 120, thereby the control arm 27 of the second circuit breaker is rotated clockwise (see FIG. 1 and FIG. 7) and eliminating its restriction on rotational movement of the control lever 8. Due to restriction of the control arm 28, the control lever 8 still maintains a certain distance from the shaft 71 of the locking means, thereby at least not affecting the reliable switch-on of the circuit breaker 2.

When, for example, both the first circuit breaker 1 and the third circuit breaker 3 switch on, driving means of the circuit breakers 1, 3 rotate the driving levers 22, 24, thereby straining 15, 16, 18, 14 (see FIG. 9) with tensile forces 125, 126. Since the wire ropes 15, 16 move by being strained, the control arms 27 and 28 move clockwise, and their restriction on the rotational movement of the control lever 8 is eliminated. The control lever 8, under the action of the tension spring 10, rotates counterclockwise and comes into contact with the shaft 71 of the locking means, thereby preventing closure of the second circuit breaker 2.

With a completely identical manner, i.e. under the condition that both the second and third circuit breakers 2, 3 close, the first circuit breaker 1 may also be locked to prevent closure of the first circuit breaker 1, and when both the first and the second circuit breakers 1, 2 switched, the third circuit breaker 3 may also be locked.

From the embodiments and the accompanying drawings, the characteristics of the structure of the present invention are that: when the control lever 8 comes into contact with the shaft 71 of the locking means, the control lever 8 is in a contact condition state; the contact force between the control lever 8 and the shaft 71 of the locking means is provided by the spring 10, which is different from the prior art in which the contact force is provided by tensile force of wire ropes; the control lever 8 adopts a shaft bearing support structure whose repetitive positioning and vibration-proof performances are better than the elastic support mechanism.

The structural characteristics of the present invention guarantee that the set of circuit breakers of the present invention has the following notable effects: good safety, robustness and reliability, ease of operating and adjusting, simple structure, low manufacturing cost, long service life and wide application, etc.

The invention claimed is:

1. A set of circuit breakers with interlock means, comprising at least three circuit breakers (1, 2, 3) and at least six cables (13, 14, 15, 16, 17, 18), each circuit breaker in said set of circuit breakers having interlock means (4), the interlock means of each circuit breaker being interconnected to translate drive force via cables, characterized in that:

each interlock means (4) comprises a drive member (20), a control member (40), a locking member, a base plate (5) and a cable mechanism (50);

the base plate (5) of said interlock means (4) is provided with at least one control lever (7; 8; 9), at least one driving lever (22; 23; 24), at least two control arms (25, 26; 27, 28; 29, 30) which are separate elements from said control lever (7; 8; 9), and three elastic elements (10, 11, 12) connected to said control lever (7; 8; 9) and said two control arms (25, 26; 27, 28; 29, 30) respectively at their first ends and fixed to the base plate (5) at their second ends;

said control lever (7; 8; 9) being connected to a trigger of a circuit breaker locking means;

said driving lever (22; 23; 24) is being operatively connected to a driving mechanism on the circuit breaker;

wire ropes of two cables connected to two ends of the driving lever (22; 23; 24) of any of said circuit breakers are respectively connected to one control arm of the other two circuit breakers;

said control arm (25, 26; 27, 28; 29, 30), under joint action of tensile force of said wire ropes and elastic force of said elastic elements (10, 11, 12) connected thereto, performs restriction or release of movement of said control lever (7; 8; 9);

said control lever (7; 8; 9), after movement restriction from the control arm is released, under the action of elastic force of said elastic element connected thereto, automatically rotates and comes into contact with a shaft (71) of the locking means to perform locking of the shaft (71) of the locking means of the circuit breaker.

2. A set of circuit breakers according to claim 1, characterized in that: in the middle of said control lever (7; 8; 9) is provided a shaft (60) accessing to the base plate (5) the shaft (60) mating with a corresponding hole on the base plate (5), such that the control lever (7; 8; 9) is rotatable on a plane parallel to the base plate the control lever (7; 8; 9) is provided with two ends at which the control lever (7; 8; 9) can be blocked to restrict the movement of the control lever (7; 8; 9).

3. A set of circuit breakers according to claim 1, characterized in that: said cable comprises wire ropes, a sheath, threaded terminals, and wiring means for the wire ropes, the wire ropes being adapted to movably pass through the sheath, two ends of the sheath being provided with threaded terminals, and two ends of wire ropes being provided with the wiring means; the sheath is fixedly connected to the base plate (5) by virtue of the threaded terminals; the wire ropes are fixedly attached to the driving lever and the control arm by virtue of the wiring means.

4. A set of circuit breakers according to claim 1, characterized in that: said elastic element (10, 11, 12) is a tension spring, a leaf spring or a torsional spring, one end of which is connected to the control arm (25, 26; 27, 28; 29, 30) or the control lever (7; 8; 9), and the other end of which is connected to the base plate (5), and the direction of an elastic force of said elastic element acting on the control arm is opposite to that of the tensile force of the wire ropes; the direction of an elastic force of said elastic element acting on the control lever (7; 8; 9) is parallel to the base plate (5).

5. A set of circuit breakers according to claim 1, characterized in that: two ends of said driving lever (22; 23; 24) have a structure bearing wire ropes, on said driving lever (22; 23; 24) is provided a shaft (60) accessing to the base plate (5) wherein the shaft (60) mates with a corresponding hole on the base plate (5) such that the driving lever (22; 23; 24) is rotatable on a plane parallel to the base plate (5).

6. A set of circuit breakers according to any one of claims 5-3, characterized in that: bearing systems between said base plate (5) and the driving lever (22; 23; 24), the control arm (25, 26; 27, 28; 29, 30), or the control lever (7; 8; 9) are respectively a hole-shaft bearing, or a shaft-hole bearing, or a slot-shaft bearing, or a shaft-slot bearing; shaft center of said shaft is perpendicular to the plane of the base plate (5).

7. A set of circuit breakers according to any one of claims 1-3, characterized in that: the driving lever (22; 23; 24), the control arms (25, 26; 27, 28; 29, 30) and the cables should have the has a connection relationship as follows: wire ropes (15, 18) connected to two ends of the driving lever (22) of the first circuit breaker (1) are respectively connected to the control arm (28) of the second circuit breaker and to the control arm (1) of the third circuit breaker (3); wire ropes (13, 17) connected to two ends of the driving lever (23) of the second circuit breaker (2) are respectively connected to the control arm (25) of the first circuit breaker (1) and to the control arm (29) of the third circuit breaker (3); and wire ropes (16, 14) connected to two ends of the driving lever (24) of the third circuit breaker (3) are respectively connected to the control arm (27) of the second circuit breaker (2) and the control arm (26) of the first circuit breaker (1).

8. A set of circuit breakers according to claim 7, characterized in that: the connection between said wire ropes and the driving lever (22; 23; 24) or the control arm (25, 26; 27, 28; 29, 30) is direct, or through at least one transitional element including a pin roll, a shaft sleeve, a latch hook, or a roller.

9. A set of circuit breakers according to claim 1, characterized in that: one ends of said control arms (25, 26; 27, 28; 29, 30) are provided a hole movably connected to a shaft fixed on the base plate (5) such that the control arms are configured to swing on a plane parallel to the base plate (5); each said control arm (25, 26; 27, 28; 29, 30) is respectively connected to the wire ropes and the elastic element so as to perform movement restriction or restriction release to the control lever (7; 8; 9) under joint action of tensile force of said wire ropes and elastic force of said elastic element.

10. A set of circuit breakers according to claim 9 or 2, characterized in that: said control lever (7; 8; 9) comes into direct contact with the control arms (25, 26; 27, 28; 29, 30) with no transitional element therebetween.

11. A set of circuit breakers according to claim 9 or 2, characterized in that: at least one transitional element for contacting is provided on the control lever (7; 8; 9) or the control arm (25, 26; 27, 28; 29, 30), the at least one transitional element including a male tab, a stopper, or a pintle.

12. A set of circuit breakers according to claim 9 or 2, characterized in that: there is no transitional element for connection between the elastic element (10, 11, 12) and the control arm (25, 26; 27, 28; 29, 30) or the control lever (7; 8; 9).

13. A set of circuit breakers according to claim 9 or 2, characterized in that: there is at least one transitional element for connection between the elastic element (10, 11, 12) and the control arm (25, 26; 27, 28; 29, 30) or the control lever (7, 8, 9), for example, the at least one transitional element including a post, a clasp, or a tab.

* * * * *